US009478160B2

(12) United States Patent
Guo et al.

(10) Patent No.: US 9,478,160 B2
(45) Date of Patent: Oct. 25, 2016

(54) DISPLAY PANEL AND DISPLAY METHOD THEREOF, AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN); Peng Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 75 days.

(21) Appl. No.: 14/415,636

(22) PCT Filed: Jun. 30, 2014

(86) PCT No.: PCT/CN2014/081195

§ 371 (c)(1),
(2) Date: Jan. 19, 2015

(87) PCT Pub. No.: WO2015/070621

PCT Pub. Date: May 21, 2015

(65) Prior Publication Data

US 2016/0019823 A1 Jan. 21, 2016

(30) Foreign Application Priority Data

Nov. 15, 2013 (CN) ..... 2013 1 0572228

(51) Int. Cl.
*G09G 3/20* (2006.01)
*G09G 3/32* (2016.01)

(52) U.S. Cl.
CPC ..... *G09G 3/2074* (2013.01); *G09G 3/2003* (2013.01); *G09G 3/3225* (2013.01); *G09G 2300/0452* (2013.01); *G09G 2320/02* (2013.01); *G09G 2320/0242* (2013.01)

(58) Field of Classification Search
CPC ..... G09G 2300/0452; G09G 3/2003; G09G 2320/0242; G09G 2340/06; G09G 2300/0443; G09G 3/2074; G02F 1/133514; G02F 2201/52; H01L 27/3213; H01L 27/3211
See application file for complete search history.

(56) References Cited

U.S. PATENT DOCUMENTS 8,208,099 B2 * 6/2012 Utsumi ..... G02F 1/133514 349/108
2006/0267892 A1 * 11/2006 Pei ..... G09G 3/3685 345/88

(Continued)

FOREIGN PATENT DOCUMENTS

CN 1716013 A 1/2006
CN 1742304 A 3/2006

(Continued)

OTHER PUBLICATIONS

1st Office Action issued in Chinese application No. 201310572228.3 dated Aug. 13, 2015.
Written Opinion of the International Searching Authority issued in International application No. PCT/CN2014/081195.

(Continued)

*Primary Examiner* — Sanjiv D Patel
(74) *Attorney, Agent, or Firm* — Nath, Goldberg & Meyer; Joshua B. Goldberg

(57) ABSTRACT

The present invention provides a display panel and a display method thereof, and a display device. The display panel comprises a plurality of circulation units, wherein each circulation unit is composed of one sub-pixel array or is composed of a plurality of sub-pixel arrays aligned in a row or column direction, and each sub-pixel array is composed of six sub-pixels arranged in two rows and three columns, wherein the six sub-pixels of each sub-pixel array include three color sub-pixels and three compensation sub-pixels, the three color sub-pixels include one red sub-pixel, one green sub-pixel and one blue sub-pixel, the three compensation sub-pixels are different from one another in color, and the sub-pixels with the same color are not adjacent to each other in the row direction and the column direction.

15 Claims, 4 Drawing Sheets

(56) References Cited

U.S. PATENT DOCUMENTS

| | | | | |
|---|---|---|---|---|
| 2006/0291745 | A1* | 12/2006 | Kang | B41J 2/2139 382/275 |
| 2007/0058115 | A1* | 3/2007 | Utsumi | G02F 1/133514 349/109 |
| 2007/0109327 | A1* | 5/2007 | Cok | G09G 3/2003 345/690 |
| 2007/0236444 | A1* | 10/2007 | Woo | G09G 3/3413 345/102 |
| 2009/0244101 | A1* | 10/2009 | Langendijk | G02F 1/133514 345/690 |
| 2012/0212515 | A1* | 8/2012 | Hamer | G09G 3/2003 345/690 |

FOREIGN PATENT DOCUMENTS

| | | | |
|---|---|---|---|
| CN | 101750791 | A | 6/2010 |
| CN | 203085546 | U | 7/2013 |
| CN | 103576366 | A | 2/2014 |
| CN | 203644321 | U | 6/2014 |
| JP | 9-251160 | A | 9/1997 |
| JP | 2003280614 | A | 10/2003 |
| JP | 2008181130 | A | 8/2008 |

OTHER PUBLICATIONS

Search Report issued in International Application No. PCT/CN2014/081195, fourteen (14) pages.

* cited by examiner

Fig. 3

| | | | | | | | |
|---|---|---|---|---|---|---|---|
| 1: | R | G | B | 4: | X | G | B |
| | X | Y | Z | | R | Y | Z |
| 2: | B | G | Y | 5: | B | Y | Z |
| | X | R | Z | | X | R | G |
| 3: | B | Y | G | 6: | B | Y | G |
| | X | R | Z | | R | X | Z |

Fig. 4

| | | | | | | | | | | | | |
|---|---|---|---|---|---|---|---|---|---|---|---|---|
| 1: | R | Y | B | X | G | Z | 2: | R | G | B | X | Y | Z |
| | X | G | Z | R | Y | B | | X | Y | Z | R | G | B |

| | | | | | | | | | | | |
|---|---|---|---|---|---|---|---|---|---|---|---|
| 3: | R | G | B | 4: | R | Y | B | 5: | R | Y | Z |
| | X | Y | Z | | X | G | Z | | X | G | B |
| | B | G | R | | Z | R | X | | Z | R | Y |
| | Z | Y | X | | G | Y | B | | G | X | B |

Fig. 5

| | | | | | | | | | | | |
|---|---|---|---|---|---|---|---|---|---|---|---|
| R | G | B | W | Q | H | R | G | B | W | Q | H |
| W | Q | H | R | G | B | W | Q | H | R | G | B |
| R | G | B | W | Q | H | R | G | B | W | Q | H |
| W | Q | H | R | G | B | W | Q | H | R | G | B |
| R | G | B | W | Q | H | R | G | B | W | Q | H |
| W | Q | H | R | G | B | W | Q | H | R | G | B |
| R | G | B | W | Q | H | R | G | B | W | Q | H |
| W | Q | H | R | G | B | W | Q | H | R | G | B |
| R | G | B | W | Q | H | R | G | B | W | Q | H |
| W | Q | H | R | G | B | W | Q | H | R | G | B |

Fig. 6

| | | | | | | | | | | | |
|---|---|---|---|---|---|---|---|---|---|---|---|
| R1 | G | B | R | G1 | B1 | R1 | G | B | R | G1 | B1 |
| R | G1 | B1 | R1 | G | B | R | G1 | B1 | R1 | G | B |
| R1 | G | B | R | G1 | B1 | R1 | G | B | R | G1 | B1 |
| R | G1 | B1 | R1 | G | B | R | G1 | B1 | R1 | G | B |
| R1 | G | B | R | G1 | B1 | R1 | G | B | R | G1 | B1 |
| R | G1 | B1 | R1 | G | B | R | G1 | B1 | R1 | G | B |
| R1 | G | B | R | G1 | B1 | R1 | G | B | R | G1 | B1 |
| R | G1 | B1 | R1 | G | B | R | G1 | B1 | R1 | G | B |

Fig. 7

| | | | | | | | | | | | |
|---|---|---|---|---|---|---|---|---|---|---|---|
| R | G | B | H | W | Q | R | G | B | H | W | Q |
| H | W | Q | R | G | B | H | W | Q | R | G | B |
| R | G | B | H | W | Q | R | G | B | H | W | Q |
| H | W | Q | R | G | B | H | W | Q | R | G | B |
| R | G | B | H | W | Q | R | G | B | H | W | Q |
| H | W | Q | R | G | B | H | W | Q | R | G | B |
| R | G | B | H | W | Q | R | G | B | H | W | Q |
| H | W | Q | R | G | B | H | W | Q | R | G | B |

Fig. 8

| | | | | | | | | | | | |
|---|---|---|---|---|---|---|---|---|---|---|---|
| R | G | B | R | G | B | R | G | B | R | G | B |
| R1 | G1 | B1 | R1 | G1 | B1 | R1 | G1 | B1 | R1 | G1 | B1 |
| B | G | R | B | G | R | B | G | R | B | G | R |
| B1 | G1 | R1 | B1 | G1 | R1 | B1 | G1 | R1 | B1 | G1 | R1 |
| R | G | B | R | G | B | R | G | B | R | G | B |
| R1 | G1 | B1 | R1 | G1 | B1 | R1 | G1 | B1 | R1 | G1 | B1 |
| B | G | R | B | G | R | B | G | R | B | G | R |
| B1 | G1 | R1 | B1 | G1 | R1 | B1 | G1 | R1 | B1 | G1 | R1 |
| R | G | B | R | G | B | R | G | B | R | G | B |
| R1 | G1 | B1 | R1 | G1 | B1 | R1 | G1 | B1 | R1 | G1 | B1 |
| B | G | R | B | G | R | B | G | R | B | G | R |
| B1 | G1 | R1 | B1 | G1 | R1 | B1 | G1 | R1 | B1 | G1 | R1 |

DISPLAY PANEL AND DISPLAY METHOD THEREOF, AND DISPLAY DEVICE

This is a National Phase Application filed under 35 U.S.C. 371 as a national stage of PCT/CN2014/081195, filed Jun. 30, 2014, and claims priority benefit from Chinese Application No. 201310572228.3, filed Nov. 15, 2013, the content of each of which is hereby incorporated by reference in its entirety.

FIELD OF THE INVENTION

The present invention relates to the field of display technology, and in particular, relates to a display panel and a display method thereof and a display device.

BACKGROUND OF THE INVENTION

In a conventional liquid crystal display device or organic light emitting diode (OLED) display device, each point (pixel) displays colors by a plurality of sub-pixels through light mixing, e.g. each pixel is composed of a red sub-pixel, a green sub-pixel and a blue sub-pixel (i.e., in RGB mode).

To improve the visual effect, the requirement for resolution (the number of pixels in a unit size) of a display device is increasingly high, this requires increasingly small size of the sub-pixels, but the size of the sub-pixels cannot be infinitely reduced due to process limitation.

To improve the display effect under the condition that the size of the sub-pixels is definite, a display device of a Pentile mode is proposed. In the display device of the Pentile mode, the number of sub-pixels of part of colors (e.g. red sub-pixels and blue sub-pixels) is halved, meanwhile, in the display device, the sub-pixels of different colors are virtualized as in different "layers", each layer is divided into a plurality of sampling areas, the divided sampling areas of each layer are not superposed, and then the content to be displayed by each sub-pixel is calculated by using an area ratio of the sampling areas. A part of the sub-pixels in the display device of the Pentile mode are "shared", so that a resolution higher than the practical resolution is achieved on the visual effect.

However, the display effect of the existing display device of the Pentile mode is still not ideal. Since the number of the sub-pixels of part of colors is halved, the sub-pixels of various colors are not uniformly distributed, and the problems of serrated grains, latticed spots, unclear display of small contents and the like are easily caused. Meanwhile, due to a calculation mode of "layer and area division", a complex calculation process is needed for calculating the content which needs to be displayed by each sub-pixel, and the calculation quantity is large.

SUMMARY OF THE INVENTION

For solving the technical problems of poor display effect and large calculation quantity in the existing high-resolution display technology, the present invention provides a display panel and a display method thereof and a display device with high resolution, good display effect and small required calculation quantity.

According to an aspect of the present invention, a display panel is provided, comprising a plurality of circulation units, wherein each circulation unit is composed of one sub-pixel array or is composed of a plurality of sub-pixel arrays aligned in a row or column direction, and each sub-pixel array is composed of six sub-pixels arranged in two rows and three columns, wherein the six sub-pixels of each sub-pixel array include three color sub-pixels and three compensation sub-pixels, the three color sub-pixels include one red sub-pixel, one green sub-pixel and one blue sub-pixel, the three compensation sub-pixels are different from one another in color, and the sub-pixels with the same color are not adjacent to each other in the row direction and the column direction.

The above-mentioned "row" and "column" are for a matrix composed of a plurality of sub-pixels, wherein the sub-pixels are arranged in a plurality of parallel straight lines along both the "row" direction and the "column" direction, and the "row" is perpendicular to the "column". Accordingly, the "row" and the "column" only indicate two opposite directions, and are irrelevant with the shape (rectangular, circular or special-shaped) of the sub-pixels and the placement manner (placed vertically, placed horizontally, upright, inverted or the like) of the display panel.

In the display panel, each circulation unit may be composed of a sub-pixel array. Specifically, the arrangement mode of the sub-pixels in the circulation unit is any of the following six modes: 1) the first row from left to right orderly include R, G and B, and the second row from left to right orderly include X, Y and Z; 2) the first row from left to right orderly include B, G and Y, and the second row from left to right orderly include X, R and Z; 3) the first row from left to right orderly include B, Y and G, and the second row from left to right orderly include X, R and Z; 4) the first row from left to right orderly include X, G and B, and the second row from left to right orderly include R, Y and Z; 5) the first row from left to right orderly include B, Y and Z, and the second row from left to right orderly include X, R and G; 6) the first row from left to right orderly include B, Y and G, and the second row from left to right orderly include R, X and Z, wherein R indicates a red sub-pixel, G indicates a green sub-pixel, B indicates a blue sub-pixel, and X, Y and Z indicate three compensation sub-pixels with different colors.

In the display panel, each circulation unit may be composed of a first sub-pixel array and a second sub-pixel array aligned in the row or column direction. Specifically, the arrangement mode of the sub-pixels in the circulation unit is any of the following five modes: 1) the first row from left to right orderly include R, Y, B, X, G and Z, and the second row from left to right orderly include X, G, Z, R, Y and B; 2) the first row from left to right orderly include R, G, B, X, Y and Z, and the second row from left to right orderly include X, Y, Z, R, G and B; 3) the first row from left to right orderly include R, G and B, the second row from left to right orderly include X, Y and Z, the third row from left to right orderly include B, G and R, and the fourth row from left to right orderly include Z, Y and X; 4) the first row from left to right orderly include R, Y and B, the second row from left to right orderly include X, G and Z, the third row from left to right orderly include Z, R and X, and the fourth row from left to right orderly include G, Y and B; 5) the first row from left to right orderly include R, Y and Z, the second row from left to right orderly include X, G and B, the third row from left to right orderly include Z, R and Y, and the fourth row from left to right orderly include G, X and B, wherein R indicates a red sub-pixel, G indicates a green sub-pixel, B indicates a blue sub-pixel, and X, Y and Z indicate three compensation sub-pixels with different colors.

In each circulation unit, colors of all sub-pixels in the same row are different from one another; and in each circulation unit, colors of all sub-pixels in the same column are different from one another.

In the display panel, three compensation sub-pixels in each sub-pixel array may include one auxiliary red sub-pixel, one auxiliary blue sub-pixel and one auxiliary green sub-pixel, wherein the auxiliary red sub-pixel is in the same column as the red sub-pixel, the auxiliary green sub-pixel is in the same column as the green sub-pixel, and the auxiliary blue sub-pixel is in the same column as the blue sub-pixel. Specifically, the auxiliary red sub-pixel is a magenta sub-pixel, the auxiliary green sub-pixel is a yellow green sub-pixel, and the auxiliary blue sub-pixel is a dark blue sub-pixel.

In the display panel, three compensation sub-pixels in each sub-pixel array may include one white sub-pixel, one yellow sub-pixel and one cyan sub-pixel.

The plurality of circulation units in the display panel are repeatedly arranged row by row, and the plurality of circulation units in the display panel are repeatedly arranged column by column, so that the plurality of circulation units cover the whole display panel.

The display panel may be an organic light emitting diode display panel, each sub-pixel includes a light emitting unit, and colors of light emitted by the light emitting units correspond to colors of the three color sub-pixels and the three compensation sub-pixels.

The display panel may also be a liquid crystal display panel, each sub-pixel comprises a filter unit, and colors of light penetrating through the filter units correspond to colors of the three color sub-pixels and the three compensation sub-pixels.

According to another aspect of the present invention, a display device is provided, comprising the above-mentioned display panel.

In the display panel and the display device of the present invention, the sub-pixels of each color are equal in number and are uniformly distributed, so that serrated grains, latticed spots and the like are not produced. Meanwhile, the sub-pixels of each color are arranged in a specific manner, so that a higher resolution may be realized on the visual effect, and the calculation quantity required in the display process is small. In addition, three different compensation sub-pixels are comprised, so that more sufficient display compensation may be performed, and a better display effect is achieved.

According to a further aspect of the present invention, a display method of the above-mentioned display panel is provided, comprising the following steps: displaying a required color component of red, green or blue at each sub-pixel position, wherein this step includes causing a plurality of color sub-pixels with the same color near a sub-pixel position to display, so that the required color component is displayed at the sub-pixel position under average effect of the color sub-pixels with the same color; and performing display compensation on at least one sub-pixel position near compensation sub-pixels by using the compensation sub-pixels.

When a color component identical to sub-pixel color of a sub-pixel position needs to be displayed at the sub-pixel position, the plurality of color sub-pixels with the same color near the sub-pixel position include a color sub-pixel at the sub-pixel position and a plurality of color sub-pixels with the color around the sub-pixel position; and when a color component different from sub-pixel color of a sub-pixel position needs to be displayed at the sub-pixel position, the plurality of color sub-pixels with the same color near the sub-pixel position include a plurality of color sub-pixels with a required color around the sub-pixel position.

When a color component identical to sub-pixel color of a sub-pixel position needs to be displayed at the sub-pixel position, the plurality of color sub-pixels with the color around the sub-pixel position may include two color sub-pixels with the color in the column of the sub-pixel position and closest to the sub-pixel position, and may further include four color sub-pixels with the color respectively in two rows adjacent to the row of the sub-pixel position, and respectively on two sides of the sub-pixel position in the row direction and closest to the sub-pixel position.

When a color component different from sub-pixel color of a sub-pixel position needs to be displayed at the sub-pixel position, the plurality of color sub-pixels with a required color around the sub-pixel position may include one color sub-pixel with the required color in the same row as the sub-pixel position and closest to the sub-pixel position, and two color sub-pixels with the required color in two rows adjacent to the row of the sub-pixel position and closest to the sub-pixel position in the row direction.

The display panel may be the one including an auxiliary red sub-pixel, an auxiliary blue sub-pixel and an auxiliary green sub-pixel, and the step of performing display compensation on at least one sub-pixel position near compensation sub-pixels by using the compensation sub-pixels includes: compensating a color sub-pixel position in the same column as and adjacent to the compensation sub-pixels by using the compensation sub-pixels, wherein colors of the color sub-pixel at the color sub-pixel position and the compensation sub-pixels belong to the same color system.

The display panel may be the one including a white sub-pixel, a cyan sub-pixel and a yellow sub-pixel, and the step of performing display compensation on at least one sub-pixel position near compensation sub-pixels by using the compensation sub-pixels includes: performing display compensation on a sub-pixel position by using a plurality of compensation sub-pixels near the sub-pixel position.

When a sub-pixel position needs display compensation and the color of the compensation sub-pixels for compensation is the same as the color of the sub-pixel at the sub-pixel position, the plurality of compensation sub-pixels near the sub-pixel position include a compensation sub-pixel at the sub-pixel position and a plurality of compensation sub-pixels with the color around the sub-pixel position; and when a sub-pixel position needs display compensation and the color of the compensation sub-pixels for compensation is different from the color of the sub-pixel at the sub-pixel position, the plurality of compensation color sub-pixels near the sub-pixel position include a plurality of compensation sub-pixels around the sub-pixel position.

When a sub-pixel position needs display compensation and the color of the compensation sub-pixels for compensation is the same as the color of the sub-pixel at the sub-pixel position, the plurality of compensation sub-pixels with the color around the sub-pixel position may include two compensation sub-pixels with the color in the column of the sub-pixel position and closest to the sub-pixel position, and may further include four compensation sub-pixels with the color respectively in two rows adjacent to the row of the sub-pixel position, and respectively on two sides of the sub-pixel position in the row direction and closest to the sub-pixel position.

When a sub-pixel position needs display compensation and the color of the compensation sub-pixels for compensation is different from the color of the sub-pixel at the sub-pixel position, the plurality of compensation sub-pixels around the sub-pixel position include one compensation sub-pixel in the same row as the sub-pixel position and closest to the sub-pixel position, and two compensation sub-pixels in two rows adjacent to the row of the sub-pixel position and closest to the sub-pixel position in the row direction.

In the display method of the present invention, all color components of red, green and blue may be displayed at each sub-pixel position (e.g. a blue component may be displayed at a red sub-pixel position by a blue sub-pixel near the red sub-pixel position), namely, a complete content may be displayed at each sub-pixel position, which is equivalent to a pixel, so the resolution on the visual effect is greatly improved. Moreover, the content displayed at each sub-pixel position is an average result of a plurality of sub-pixels near the sub-pixel position, so the displayed color is uniform and soft and the display effect is good. In addition, each sub-pixel position is used as a unit for displaying, and the contents which need to be displayed by the sub-pixels near the sub-pixel position are correspondingly calculated, so that complex calculation of "layer and area division" is not needed, the calculation quantity is small, and the method is easy to be implemented. Meanwhile, due to the three different compensation sub-pixels, more sufficient display compensation may be performed, and a better display effect is achieved.

BRIEF DESCRIPTION OF THE DRAWINGS

FIG. 3 is a schematic diagram of a sub-pixel arrangement mode in six circulation units of a display panel of an embodiment of the present invention.

FIG. 4 is a schematic diagram of a sub-pixel arrangement mode in another five circulation units of a display panel of an embodiment of the present invention.

FIG. 5 is a schematic diagram of color display in a display panel of an embodiment of the present invention.

FIG. 6 is a schematic diagram of color display in another display panel of an embodiment of the present invention.

FIG. 7 is a schematic diagram of display compensation in a display panel of an embodiment of the present invention.

FIG. 8 is a schematic diagram of display compensation in another display panel of an embodiment of the present invention.

DESCRIPTION OF THE PREFERRED EMBODIMENT

To make those skilled in the art better understand the technical solutions of the present invention, the present invention will be further described in detail below in combination with the accompanying drawings and specific implementations.

Figure 1:
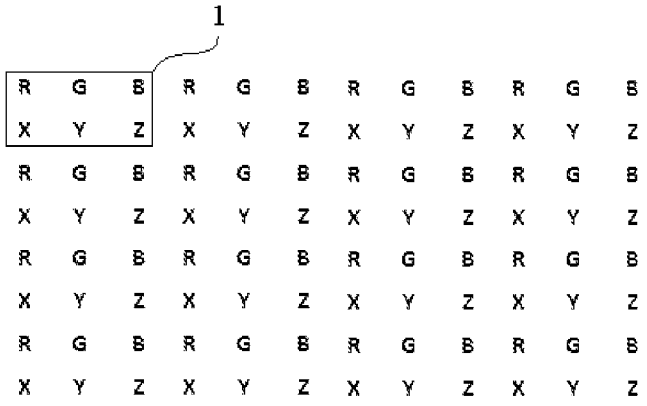
FIG. 1 is a schematic diagram of a sub-pixel arrangement mode of a display panel of an embodiment of the present invention.
Figure 2:
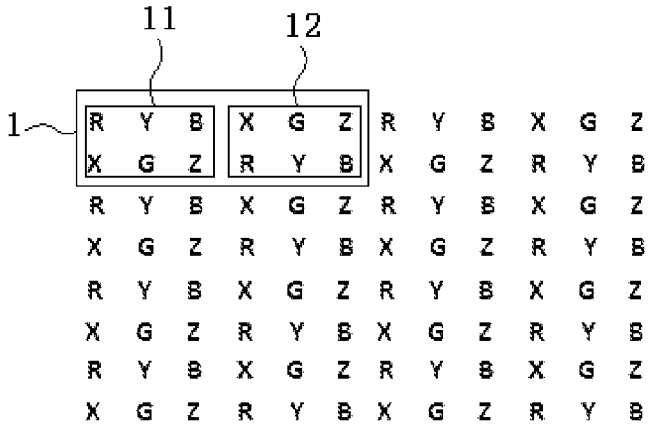
FIG. 2 is a schematic diagram of another sub-pixel arrangement mode of a display panel of an embodiment of the present invention.

As shown in FIG. 1 and FIG. 2, a display panel of an embodiment of the present invention comprises a plurality of circulation units 1, each circulation unit 1 is composed of one sub-pixel array or is composed of a plurality of sub-pixel arrays aligned in a row (or column) direction, each sub-pixel array is composed of six sub-pixels arranged in two rows and three columns, and the six sub-pixels in each sub-pixel array include three color sub-pixels and three compensation sub-pixels. The three color sub-pixels include one red sub-pixel, one green sub-pixel and one blue sub-pixel, the three compensation sub-pixels are different from one another in color (namely, they are three different sub-pixels), and the sub-pixels with the same color are not adjacent to each other (adjacent to each other refers to leaning against each other without intervals therebetween) in the row direction and the column direction.

That is to say, the display panel of the embodiment of the present invention comprises six sub-pixels, namely red, green and blue color sub-pixels for displaying required color components and three compensation sub-pixels for display compensation, wherein each six different sub-pixels constitute a sub-pixel array, one or more sub-pixel arrays constitute a circulation unit 1, and a plurality of circulation units 1 are arranged into a matrix and are finally arranged on the whole display panel. That is to say, each circulation unit 1 may be regarded as a "point", and the "points" are arranged into a matrix.

In the display panel of the embodiment of the present invention, the sub-pixels of each color are equal in number and are uniformly distributed, so that serrated grains, latticed spots and the like are not produced. Meanwhile, the sub-pixels of each color are arranged in a specific manner, so that a higher resolution may be realized on the visual effect, and the calculation quantity in the display process is small. In addition, three different compensation sub-pixels are comprised, so that more sufficient display compensation may be performed, and the display effect is good.

For example, the plurality of circulation units 1 cover the whole display panel, and more specifically, the plurality of circulation units 1 are repeatedly arranged row by row and column by column. That is to say, the display panel may be "filled" with the circulation units 1, and are not provided with sub-pixels arranged in other manners.

For example, in each circulation unit 1, the colors of all sub-pixels in the same row are different from one another, and the colors of all sub-pixels in the same column are different from one another. That is to say, when the circulation unit 1 is composed of a plurality of sub-pixel arrays, the circulation unit 1 inevitably comprises the sub-pixels of the same color, but all the sub-pixels in any row and any column may be different from one another, so that the sub-pixels with different colors are distributed more uniformly, and a better display effect is achieved.

In FIG. 1, as an embodiment of the present invention, each circulation unit 1 is composed of one sub-pixel array, namely, each circulation unit 1 is composed of six sub-pixels with different colors and arranged in two rows and three columns, that is to say, the circulation unit 1 is a sub-pixel array.

Under such a condition, the arrangement mode of the sub-pixels of the circulation unit 1 is any of six modes shown in FIG. 3, wherein R indicates a red sub-pixel, G indicates a green sub-pixel, B indicates a blue sub-pixel, and X, Y and Z indicate three compensation sub-pixels with different colors. A good display effect may be achieved by using the six arrangement modes.

Moreover, as another embodiment of the present invention, in FIG. 2, each circulation unit 1 may also be composed of a first sub-pixel array 11 and a second sub-pixel array 12 aligned in the row or column direction.

That is to say, each circulation unit 1 may also be composed of two sub-pixel arrays (a first sub-pixel array 11 and a second sub-pixel array 12), each of the two sub-pixel arrays 11 and 12 is composed of six sub-pixels arranged in two rows and three columns, the two rows of the two sub-pixel arrays are aligned with each other respectively, or the three columns of the two sub-pixel arrays are aligned with each other respectively, the finally formed circulation unit 1 is in the form of two rows and six columns or four rows and three columns and comprises 12 sub-pixels, these sub-pixels have six different colors, and two sub-pixels are involved in each color.

Under such a condition, the arrangement mode of the sub-pixels of the circulation unit 1 is any of five modes shown in FIG. 4, wherein R indicates a red sub-pixel, G indicates a green sub-pixel, B indicates a blue sub-pixel, and X, Y and Z indicate three compensation sub-pixels with different colors. A good display effect may be achieved by using the five arrangement modes.

Certainly, the circulation unit 1 may also be composed of three or more sub-pixel arrays, and the arrangement mode of each sub-pixel array may be in other forms different from that in FIG. 2 and FIG. 4, which is not described one by one herein.

As shown in FIG. 5 and FIG. 7, three compensation sub-pixels in each sub-pixel array may include one white sub-pixel, one yellow sub-pixel and one cyan sub-pixel, wherein W indicates the white sub-pixel, H indicates the yellow sub-pixel, and Q indicates the cyan sub-pixel.

That is to say, the three compensation sub-pixels X, Y and Z may be sub-pixels of three colors including W (white sub-pixel), H (yellow sub-pixel) and Q (cyan sub-pixel), wherein the white sub-pixel may improve the display brightness, and human vision is insensitive to yellow and cyan, so the yellow and cyan sub-pixels may effectively improve the sensitivity of yellow and cyan. Of course, the corresponding relation between the W, H and Q sub-pixels and the X, Y and Z sub-pixels in the figures at the moment is not unique, as long as the X, Y and Z sub-pixels respectively indicate the W, H and Q sub-pixels on the whole, it is unnecessary that X corresponds W, Y corresponds to H and Z corresponds to Q, namely, X may correspond to H or Q, Y may correspond to W or Q, Z may correspond to W or H, and the sub-pixels may be arranged and combined according to actual needs.

Moreover, as shown in FIG. 6 and FIG. 8, three compensation sub-pixels in each sub-pixel array may include one auxiliary red sub-pixel, one auxiliary blue sub-pixel and one auxiliary green sub-pixel, wherein the auxiliary red sub-pixel is in the same column as the red sub-pixel, the auxiliary green sub-pixel is in the same column as the green sub-pixel, and the auxiliary blue sub-pixel is in the same column as the blue sub-pixel; and R1, G1 and B1 are respectively the auxiliary red sub-pixel, the auxiliary green sub-pixel and the auxiliary blue sub-pixel.

In this case, the "auxiliary red sub-pixel" means that, in the display panel, the color of the red sub-pixel corresponds to red of a certain specific wavelength (referred to as "bright red"), whereas the wavelength of the color of the "auxiliary red sub-pixel" still belongs to the range of a "red series", but the "auxiliary red sub-pixel" is "other red" different from the color of the red sub-pixel. The meanings of the "auxiliary green sub-pixel" and the "auxiliary blue sub-pixel" are similar to this, and the colors of the "auxiliary green sub-pixel" and the "auxiliary blue sub-pixel" are "other green" and "other blue" different from the colors of the green sub-pixel and the blue sub-pixel, respectively, which is no longer described in detail herein.

That is to say, the three compensation sub-pixels may also correspond to three "auxiliary sub-pixels" including the auxiliary red sub-pixel, the auxiliary blue sub-pixel and the auxiliary green sub-pixel, so that the contents displayed by the color sub-pixels may adjusted by the three compensation sub-pixels, displayed pictures are more vivid and the color gamut is wider. Meanwhile, in one sub-pixel array, the "auxiliary sub-pixel" corresponding to a certain color sub-pixel must be in the same column as the color sub-pixel, so that at least one of two adjacent sub-pixels above and below any color sub-pixel on the whole display panel is the "auxiliary sub-pixel" corresponding to the color of the color sub-pixel.

For example, the auxiliary red sub-pixel is a magenta sub-pixel, the auxiliary green sub-pixel is a yellow green sub-pixel, and the auxiliary blue sub-pixel is a dark blue sub-pixel. That is to say, the magenta, yellow green and dark blue sub-pixels may be used as "auxiliary sub-pixels" of the red, green and blue sub-pixels respectively. Researches discover that, for the three primary colors including red, green and blue generally adopted in the color sub-pixels, magenta, yellow green and dark blue may achieve a good compensation effect.

Each sub-pixel in the display panel may independently emit light with required color and brightness. Generally, the sub-pixels are controlled by a thin-film transistor array (active drive array), each sub-pixel corresponds to at least one thin-film transistor (for an organic light emitting diode display device, each sub-pixel corresponds to a plurality of thin-film transistors), and the thin-film transistors are arranged to form an array and controlled by gate lines and data lines.

For example, the display panel may be an organic light emitting diode display panel, each sub-pixel comprises a light emitting unit, and the colors of light emitted by the light emitting units of the sub-pixels correspond to the colors of the three color sub-pixels and the three compensation sub-pixels.

That is to say, the display panel of this embodiment may be an organic light emitting diode display panel, wherein an organic light emitting diode (light emitting unit) is provided at each sub-pixel, the organic light emitting diodes may emit light with different colors (which may be realized by using different organic light emitting layers), and the color of light emitted by each organic light emitting diode is the same as that of the sub-pixel where the organic light emitting diode is located, e.g. the organic light emitting diode at the red sub-pixel emits red light.

Moreover, for example, the display panel may also be a liquid crystal display panel, each sub-pixel of the display panel comprises a filter unit, and the colors of light penetrating through the filter units of the sub-pixels correspond to the colors of three color sub-pixels and three compensation sub-pixels.

That is to say, the display panel of this embodiment may also be a liquid crystal display panel, the liquid crystal display panel itself does not emit light, and light coming from a back light source is filtered to realize display, wherein a color filter membrane (filter unit) with different color is arranged at each sub-pixel, light penetrating through the color filter membrane may be converted to the corresponding color, and the color of the color filter membrane at each sub-pixel is the same as the color of the sub-pixel, e.g. the color filter membrane at the red sub-pixel is red, etc.

Certainly, other types of display panels are also feasible, as long as lights with corresponding colors are emitted at the sub-pixels, and the different types of display panels may adopt known structures and therefore are no longer described in detail herein.

An embodiment of the present invention further provides a display device, comprising the above-mentioned display panel.

Moreover, an embodiment of the present invention further provides a display method of the above-mentioned display panel, comprising the following steps: displaying a required color component of red, green or blue at each sub-pixel position, wherein this step includes causing a plurality of color sub-pixels with the same color near a sub-pixel position to display, so that the required color component is displayed at the sub-pixel position under the average effect of the color sub-pixels with the same color; and performing display compensation on at least one sub-pixel position near compensation sub-pixels by using the compensation sub-pixels.

In this case, the above two steps indicate two operations in the display process, namely, displaying the components of red, green and blue and performing display compensation, so the two steps unnecessarily involve a precedence relationship in time sequence.

It is thus clear that, in the display method of the embodiment of the present invention, all required color components may be displayed (namely red, green and blue color components may be displayed) at each sub-pixel position (rather than each sub-pixel), and each color component of each sub-pixel position is displayed by a plurality of color sub-pixels with corresponding colors near the sub-pixel position together, so that the required color component is displayed at the sub-pixel position under the average effect of the color sub-pixels. Meanwhile, display compensation is performed on the sub-pixel position near three compensation sub-pixels by using the three compensation sub-pixels in the embodiment of the present invention, so as to improve the display effect.

The display method of the embodiment of the present invention has the following advantages: 1, all color components may be displayed at each sub-pixel position (e.g. a blue component may be displayed at a red sub-pixel position by blue sub-pixels near the red sub-pixel position), namely, a complete content may be displayed at each sub-pixel position, and each sub-pixel position is equivalent to one "pixel", so that the resolution on the visual effect is greatly improved; 2, display compensation may be performed by using the three compensation sub-pixels, so that a good display effect is achieved; 3, the content displayed (compensated) at each sub-pixel position is an average result of a plurality of sub-pixels near the sub-pixel position, so the displayed color is uniform and soft and the display effect is good; and 4, each sub-pixel position is used as a unit for displaying in the display method of this embodiment, and the contents which need to be displayed by the sub-pixels near the sub-pixel position are correspondingly calculated, so that the content displayed by each sub-pixel may be directly calculated, complex calculation of "layer and area division" is not needed, the calculation quantity is small, and the method is easy to be implemented.

In the display method of the embodiment of the present invention, when a color component identical to the sub-pixel color of a sub-pixel position needs to be displayed at the sub-pixel position (e.g. a red component needs to be displayed at the red sub-pixel position), the plurality of color sub-pixels with the same color near the sub-pixel position include a color sub-pixel (the red sub-pixel) at the sub-pixel position and a plurality of color sub-pixels (red sub-pixels) with the color around the sub-pixel position.

In addition, when a color component different from the sub-pixel color of a sub-pixel position needs to be displayed at the sub-pixel position (e.g. a green component needs to be displayed at the red sub-pixel position), the plurality of color sub-pixels with the same color near the sub-pixel position include a plurality of color sub-pixels with a required color (green sub-pixels) around the sub-pixel position. That is to say, the "the color sub-pixels with the same color near the sub-pixel position" do not include the sub-pixel at the sub-pixel position (due to different color).

According to different needs, the selection method of "the color sub-pixels with the same color near the sub-pixel position" is diverse.

For example, as shown in FIG. 6, when a color component identical to the sub-pixel color of a sub-pixel position needs to be displayed at the sub-pixel position, the plurality of color sub-pixels with the color around the sub-pixel position include two color sub-pixels with the color in the column of the sub-pixel position and closest to the sub-pixel position, namely, two closest color sub-pixels with a required color in the column of the sub-pixel position and on the upper and lower sides of the sub-pixel position respectively. Moreover, the plurality of color sub-pixels with the color around the sub-pixel position may further include four color sub-pixels with the color respectively in two rows adjacent to the row of the sub-pixel position, and respectively on two sides of the sub-pixel position in the row direction and closest to the sub-pixel position.

That is to say, as shown in FIG. 6, when a green component needs to be displayed at the circled green sub-pixel position in the figure, the green component is displayed by a plurality of color sub-pixels around the green sub-pixel position besides the green sub-pixel position itself, the "color sub-pixels around the green sub-pixel position" include two boxed green sub-pixels in the same column as and closest to the green sub-pixel position (namely, two boxed green sub-pixels above and below the green sub-pixel position). Moreover, as shown in FIG. 6, in addition to the two boxed green sub-pixels above and below the green sub-pixel position, the "color sub-pixels around the green sub-pixel position" may further include four boxed green sub-pixels in two rows adjacent to the row of the green sub-pixel position (two in each row), respectively on right and left sides of the green sub-pixel position (two on each side) and closest to the green sub-pixel position.

On the other hand, when a color component different from the sub-pixel color of a sub-pixel position needs to be displayed at the sub-pixel position, the plurality of color sub-pixels with a required color around the sub-pixel position includes one color sub-pixel with the required color in the same row as the sub-pixel position and closest to the sub-pixel position, and two color sub-pixels with the required color in two rows adjacent to the row of the sub-pixel position and closest to the sub-pixel position in the row direction.

That is to say, as shown in FIG. 5, when a red component needs to be displayed at the circled white sub-pixel position in the figure, the "color sub-pixels around the white sub-pixel position" include the boxed red sub-pixel in the same row as the sub-pixel position and closest to the sub-pixel position, and two boxed red sub-pixels in two rows above and below the row of the sub-pixel position and closest to the sub-pixel position in the row direction (namely, in the same column as the white sub-pixel position as shown in the figure). It is thus clear that, when the above condition is satisfied, the three "color sub-pixels around the white sub-pixel position" definitely constitute an "isosceles triangle", the bottom edge of the isosceles triangle is parallel to the column direction, and the sub-pixel position is located in the triangle.

The above selection method of the "color sub-pixels around the sub-pixel position" may ensure that the selected color sub-pixels are close to the sub-pixel position and are not too much in number, so that a good display effect may be achieved and over large calculation quantity during display may be avoided.

In the display method of the embodiment of the present invention, the specific method of "performing display compensation on at least one sub-pixel position near compensation sub-pixels by using the compensation sub-pixels" may be different according to different types of the compensation sub-pixels.

For the above-mentioned condition that the compensation sub-pixels include a white sub-pixel, a yellow sub-pixel and a cyan sub-pixel, the compensation mode is similar to the display mode with the color sub-pixels and includes: performing display compensation on a sub-pixel position by using a plurality of compensation sub-pixels near the sub-pixel position.

For example, when a sub-pixel position needs display compensation and the color of the compensation sub-pixels for compensation is the same as the color of the sub-pixel at the sub-pixel position, the plurality of compensation sub-pixels near the sub-pixel position include a compensation sub-pixel at the sub-pixel position and a plurality of compensation sub-pixels around the sub-pixel position.

Moreover, when a sub-pixel position needs display compensation and the color of the compensation sub-pixels for compensation is different from the color of the sub-pixel at the sub-pixel position, the plurality of compensation sub-pixels near the sub-pixel position include a plurality of compensation sub-pixels around the sub-pixel position.

That is to say, similar to the condition that the color components are displayed, under such a condition, when display compensation is performed, according to different class of the sub-pixel at the sub-pixel position requiring to be compensated, the selection method of the plurality of compensation sub-pixels near the sub-pixel position is also different, and the plurality of compensation sub-pixels near the sub-pixel position may include the sub-pixel at the sub-pixel position (when the sub-pixel at the sub-pixel position has the same color as the compensation sub-pixels) or not include the sub-pixel at the sub-pixel position (when the sub-pixel at the sub-pixel position is different from the compensation sub-pixels in color).

Similar to the condition that the color components are displayed, when display compensation is performed, the selection method of the "compensation sub-pixels around the sub-pixel position" is also diverse.

As shown in FIG. 7, when a sub-pixel position needs display compensation and the color of the compensation sub-pixels for compensation is the same as the color of the sub-pixel at the sub-pixel position, the plurality of compensation sub-pixels around the sub-pixel position may include two compensation sub-pixels with the color in the column of the sub-pixel position and closest to the sub-pixel position, and may further include four compensation sub-pixels with the color respectively in two rows adjacent to the row of the sub-pixel position, and respectively on two sides of the sub-pixel position in the row direction and closest to the sub-pixel position.

That is to say, as shown in FIG. 7, when compensation in the same type as a compensation sub-pixel is performed on a compensation sub-pixel position, e.g. when cyan compensation is performed on the circled cyan sub-pixel position in the figure, the "compensation sub-pixels around sub-pixel position" may include two boxed cyan sub-pixels above and below the circled cyan sub-pixel position in the figure and may further include other four boxed cyan sub-pixels connected by dotted lines in the figure.

On the other hand, when a sub-pixel position needs display compensation and the color of the compensation sub-pixels for compensation is different from the color of the sub-pixel at the sub-pixel position, the plurality of compensation sub-pixels around the sub-pixel position include one compensation sub-pixel in the same row as the sub-pixel position and closest to the sub-pixel position, and two compensation sub-pixels in two rows adjacent to the row of the sub-pixel position and closest to the sub-pixel position in the row direction.

That is to say, when a sub-pixel position is compensated in different type from the sub-pixel at the sub-pixel position, the "compensation sub-pixels around the sub-pixel position" may include three compensation sub-pixels constituting an "isosceles triangle" similar to that shown in FIG. 5.

In addition, for the above condition that the compensation sub-pixels include an auxiliary red sub-pixel, an auxiliary blue sub-pixel and an auxiliary green sub-pixel, the "performing display compensation on at least one sub-pixel position near compensation sub-pixels by using the compensation sub-pixels" is specifically: compensating a color sub-pixel position in the same column as and adjacent to the compensation sub-pixels by using the compensation sub-pixels, wherein the color of the color sub-pixel at the color sub-pixel position and the color of the compensation sub-pixels belong to the same color system.

That is to say, as shown in FIG. 8, the compensation mode is different from the compensation mode when the compensation sub-pixels are white, cyan and yellow ones, it is really not each sub-pixel position is compensated, but only the position of a color sub-pixel is compensated, and the color of the adopted compensation sub-pixel and the color of the color sub-pixel belong to the same color system (or "correspond to each other"), namely, the red sub-pixel is compensated by using an auxiliary red sub-pixel, the green sub-pixel is compensated by using an auxiliary green sub-pixel, and the blue sub-pixel is compensated by using an auxiliary blue sub-pixel. Meanwhile, as mentioned above, at the moment, in the column direction, at least one of two sub-pixels above and below each compensation sub-pixel ("auxiliary sub-pixel") is a color sub-pixel corresponding to the compensation sub-pixel in color, so the color sub-pixel position in the same column as and adjacent to a compensation sub-pixel may be compensated by using the compensation sub-pixel. Accordingly, at least one of two sub-pixels above and below each color sub-pixel position is a compensation sub-pixel corresponding to the color sub-pixel at the color sub-pixel position in color, so each color sub-pixel is also compensated by using the compensation sub-pixel in the same column as and adjacent to the color sub-pixel and in correspondence to the color sub-pixel in color.

For example, the circled red sub-pixel and blue sub-pixel in FIG. 8 are respectively compensated by the boxed auxiliary red sub-pixel and auxiliary blue sub-pixel below them, the circled green sub-pixel is compensated by the two boxed auxiliary green sub-pixels above and below the green sub-pixel. Accordingly, each auxiliary red sub-pixel and each auxiliary blue sub-pixel are respectively used for compensating the red sub-pixel and the blue sub-pixel above them, and each auxiliary green sub-pixel is used for compensating the green sub-pixels above and below the auxiliary green sub-pixel.

It should be understood that, in the embodiments of the present invention, the content of each sub-pixel position is displayed (compensated) by a plurality of sub-pixels together, and accordingly, each sub-pixel is not only used for display at a position, but also used for displays at multiple sub-pixel positions. For example, as shown in FIG. 5, the three boxed red sub-pixels in the figure are at work when a red component needs to be displayed at the circled white sub-pixel position and are also at work when a red component needs to be displayed at the circled cyan sub-pixel position.

It should be understood that, the selection method of the "color (compensation) sub-pixels around sub-pixel position" above is not used for limiting the embodiments of the present invention, e.g. for the condition shown in FIG. 6, the "color (compensation) sub-pixels around the circled sub-pixel position" may include two boxed sub-pixels above and below the circled sub-pixel position, or may include six boxed sub-pixels or other more sub-pixels around the circled sub-pixel position. In a word, color (compensation) sub-pixels relatively close to a certain sub-pixel position may be the "color (compensation) sub-pixels around the sub-pixel position".

It should be understood that, the selection method of the "color (compensation) sub-pixels around the sub-pixel position" above may be changed at any time according to the specific displayed contents. For example, in different frames of pictures, "the color (compensation) sub-pixels around the sub-pixel position" used when the same color is displayed at the same sub-pixel position may be different (e.g. three sub-pixels are used in the first frame of picture, and four sub-pixels are used in the second frame of picture). Further, in a frame of picture, the selection methods of the "color (compensation) sub-pixels around the sub-pixel position" for different sub-pixel positions may also be different, e.g. in FIG. 8, the circled red and blue sub-pixel positions are respectively compensated by using one compensation sub-pixel, and the circled green sub-pixel position is compensated by using two compensation sub-pixels.

It should be understood that, when the "color (compensation) sub-pixels around the sub-pixel position" are determined, the selection methods of the "color (compensation) sub-pixels around the sub-pixel position" for the sub-pixel positions close to the edges of the display panel may be different from above, e.g. there is no other sub-pixels above the top row of sub-pixel positions of the display panel, so only the sub-pixels below the top row of sub-pixel positions may be used as the "color (compensation) sub-pixels around the sub-pixel position".

It could be understood that, the above implementation ways are merely exemplary embodiments adopted for describing the principle of the present invention, but the present invention is not limited thereto. Various modifications and improvements may be made by those of ordinary skill in the art without departing from the spirit and essence of the present invention, and these modifications and improvements are contemplated as within the protection scope of the present invention.

The invention claimed is:

1. A display method of a display panel, the display panel comprising a plurality of circulation units, wherein each circulation unit is composed of one sub-pixel array or is composed of a plurality of subpixel arrays aligned in a row or column direction, and each sub-pixel array is composed of six sub-pixels arranged in two rows and three columns, wherein the six sub-pixels of each sub-pixel array comprise three color sub-pixels and three compensation sub-pixels, the three color sub-pixels comprise one red sub-pixel, one green sub-pixel and one blue sub-pixel, the three compensation sub-pixels are different from one another in color, and the sub-pixels with the same color are not adjacent to each other in the row direction and the column direction, the display method comprises steps of:

displaying a required color component of red, green or blue at each sub-pixel position, wherein this step comprises causing a plurality of color sub-pixels with the same color near a sub-pixel position to display, so that the required color component is displayed at the sub-pixel position under an average effect of the color sub-pixels with the same color; and performing display compensation on at least one sub-pixel position near compensation sub-pixels by using the compensation sub-pixels, wherein this step comprises performing display compensation on a sub-pixel position by using a plurality of compensation sub-pixels near the sub-pixel position, wherein when a sub-pixel position needs display compensation and the compensation sub-pixels for compensation have a color the same as that of the subpixel at the sub-pixel position, the plurality of compensation sub-pixels near the subpixel position comprise a compensation sub-pixel at the sub-pixel position and a plurality of compensation sub-pixels with the color around the sub-pixel position, and when a sub-pixel position needs display compensation and the compensation subpixels for compensation have a color different from that of the sub-pixel at the subpixel position, the plurality of color sub-pixels near the sub-pixel position comprise a plurality of compensation sub-pixels around the sub-pixel position.

2. The display method of claim 1, wherein when a color component identical to the sub-pixel color of a sub-pixel position needs to be displayed at the sub-pixel position, the plurality of color sub-pixels with the same color near the sub-pixel position comprise a color sub-pixel at the sub-pixel position and a plurality of color sub-pixels with the color around the sub-pixel position; and when a color component different from the sub-pixel color of a sub-pixel position needs to be displayed at the sub-pixel position, the plurality of color sub-pixels with the same color near the sub-pixel position comprise a plurality of color sub-pixels with a required color around the sub-pixel position.

3. The display method of claim 2, wherein when a color component identical to the sub-pixel color of a sub-pixel position needs to be displayed at the sub-pixel position, the plurality of color sub-pixels with the color around the sub-pixel position comprise:

two color sub-pixels with the color in the column of the sub-pixel position and closest to the sub-pixel position.

4. The display method of claim 3, wherein the plurality of color sub-pixels with the color around the sub-pixel position further comprise:

four color sub-pixels with the color respectively in two rows adjacent to the row of the sub-pixel position, and respectively on two sides of the sub-pixel position in the row direction and closest to the sub-pixel position.

5. The display method of claim 2, wherein when a color component different from the sub-pixel color of a sub-pixel position needs to be displayed at the sub-pixel position, the plurality of color sub-pixels with a required color around the sub-pixel position comprise:

a color sub-pixel with the required color in the same row as the sub-pixel position and closest to the sub-pixel position, and two color sub-pixels with the required color in two rows adjacent to the row of the sub-pixel position and closest to the sub-pixel position in the row direction.

6. The display method of claim 1, wherein three compensation sub-pixels in each sub-pixel array of the display panel comprise one auxiliary red sub-pixel, one auxiliary blue sub-pixel and one auxiliary green sub-pixel.

7. The display method of claim 6, wherein the auxiliary red sub-pixel is a magenta sub-pixel, the auxiliary green sub-pixel is a yellow green sub-pixel, and the auxiliary blue sub-pixel is a dark blue sub-pixel.

8. The display method of claim 1, wherein three compensation sub-pixels in each sub-pixel array of the display panel comprise one white sub-pixel, one yellow sub-pixel and one cyan sub-pixel.

9. The display method of claim 1, wherein when a sub-pixel position needs display compensation and the color of the compensation sub-pixels for compensation is the same as the color of the sub-pixel at the sub-pixel position, the plurality of compensation sub-pixels with the color around the sub-pixel position comprise:

two compensation sub-pixels with the color in the column of the sub-pixel position and closest to the sub-pixel position.

10. The display method of claim 9, wherein the plurality of compensation sub-pixels with the color around the sub-pixel position further comprise:

four compensation sub-pixels with the color respectively in two rows adjacent to the row of the sub-pixel position, and respectively on two sides of the sub-pixel position in the row direction and closest to the sub-pixel position.

11. The display method of claim 1, wherein when a sub-pixel position needs display compensation and the color of the compensation sub-pixels for compensation is different from the color of the sub-pixel at the sub-pixel position, the plurality of compensation sub-pixels around the sub-pixel position comprise:

a compensation sub-pixel in the same row as the sub-pixel position and closest to the sub-pixel position, and two compensation sub-pixels in two rows adjacent to the row of the sub-pixel position and closest to the sub-pixel position in the row direction.

12. The display method of claim 1, wherein each circulation unit is composed of one sub-pixel array.

13. The display method of claim 12, wherein the sub-pixels in the circulation unit has an arrangement mode of any one of the following six modes:

1) a first row from left to right orderly include R, G and B, and a second row from left to right orderly include X, Y and Z;

2) a first row from left to right orderly include B, G and Y, and a second row from left to right orderly include X, R and Z;

3) a first row from left to right orderly include B, Y and G, and a second row from left to right orderly include X, R and Z;

4) a first row from left to right orderly include X, G and B, and a second row from left to right orderly include R, Y and Z;

5) a first row from left to right orderly include B, Y and Z, and a second row from left to right orderly include X, R and G; and 6) a first row from left to right orderly include B, Y and G, and a second row from left to right orderly include R, X and Z, wherein R indicates a red sub-pixel, G indicates a green sub-pixel, B indicates a blue sub-pixel, and X, Y and Z indicate three compensation sub-pixels with different colors.

14. The display method of claim 1, wherein each circulation unit is composed of a first sub-pixel array and a second sub-pixel array aligned in the row or column direction.

15. The display method of claim 14, wherein the sub-pixels in the circulation unit has an arrangement mode of any one of the following five modes:

1) a first row from left to right orderly include R, Y, B, X, G and Z, and a second row from left to right orderly include X, G, Z, R, Y and B;

2) a first row from left to right orderly include R, G, B, X, Y and Z, and a second row from left to right orderly include X, Y, Z, R, G and B;

3) a first row from left to right orderly include R, G and B, a second row from left to right orderly include X, Y and Z, a third row from left to right orderly include B, G and R, and a fourth row from left to right orderly include Z, Y and X;

4) a first row from left to right orderly include R, Y and B, a second row from left to right orderly include X, G and Z, a third row from left to right orderly include Z, R and X, and a fourth row from left to right orderly include G, Y and B; and 5) a first row from left to right orderly include R, Y and Z, a second row from left to right orderly include X, G and B, a third row from left to right orderly include Z, R and Y, and a fourth row from left to right orderly include G, X and B, wherein R indicates a red sub-pixel, G indicates a green sub-pixel, B indicates a blue sub-pixel, and X, Y and Z indicate three compensation sub-pixels with different colors.

* * * * *